United States Patent [19]

Cipolla et al.

[11] Patent Number: 5,041,840

[45] Date of Patent: Aug. 20, 1991

[54] MULTIPLE FREQUENCY ANTENNA FEED

[76] Inventors: Frank Cipolla, 3367 Marcy Ct., Simi Valley, Calif. 93065; Michael Sarcione, 28 Dorothy Rd., Millbury, Mass. 01527; Jeffrey Upton, 19 Davis Rd., Apt. C-8, Acton, Mass. 01720; Barry VanWyck, 16 Marshall St., Billerica, Mass. 01821

[21] Appl. No.: 37,905

[22] Filed: Apr. 13, 1987

[51] Int. Cl.[5] ..... H01Q 13/100; H01Q 13/080; H01Q 1/380

[52] U.S. Cl. ..... 343/725; 343/700 MS; 343/781 R; 343/786

[58] Field of Search ..... 343/700 MS, 725, 771, 343/772, 778, 786, 830, 893

[56] References Cited

U.S. PATENT DOCUMENTS

| | | | |
|---|---|---|---|
| 3,482,248 | 12/1969 | Jones, Jr. | 343/725 |
| 3,508,277 | 4/1970 | Ware et al. | 343/786 |
| 3,701,158 | 10/1972 | Johnson | 343/725 |
| 3,710,255 | 1/1973 | Gicca | 324/4 |
| 3,763,493 | 10/1973 | Shimada et al. | 343/755 |
| 3,771,158 | 11/1973 | Hatcher | 343/728 |
| 3,803,617 | 4/1974 | Fletcher et al. | 343/786 |
| 4,168,504 | 9/1979 | Davis | 343/786 |
| 4,198,640 | 4/1980 | Bowman | 343/754 |
| 4,258,366 | 3/1981 | Green | 343/786 |
| 4,342,036 | 7/1982 | Scott et al. | 343/836 |
| 4,442,437 | 4/1984 | Chu et al. | 343/786 |
| 4,450,449 | 5/1984 | Jewitt | 343/700 MS |
| 4,559,539 | 12/1985 | Markowitz et al. | 343/725 |
| 4,583,579 | 9/1985 | Teshirogi | 343/700 MS |
| 4,631,544 | 12/1986 | Ploussios | 343/771 |

OTHER PUBLICATIONS

"Wide-Band Communication Satellite Antenna Using a Multifrequency Primary Horn", Kumazawa et al, May 1975, IEEE Transactions on Antennas and Progogation, pp. 404–407.

"Dielectric Lens Antenna for EHF Airborne Satellite Communication Terminals", Rotman et al., Feb. 1982, Technical Report 592, Lincoln Laboratory, Massachusetts Institute of Technology.

"A Dual-Polarized 5-Frequency Feed", Williams et al., COMSAT Laboratories, MD.

"Signal Separator for Dual-Frequency Antenna" by W. Hartop, NASA Tech Briefs, 1979.

*Primary Examiner*—Michael C. Wimer
*Assistant Examiner*—Peter Toby Brown
*Attorney, Agent, or Firm*—Christopher L. Maginniss; Richard M. Sharkansky

[57] ABSTRACT

A multiple band antenna feed used with parabolic reflector antennas and the like. The feed is arranged as two coaxially disposed waveguides. A planar array of patch elements is disposed at the end of the coaxial waveguides so the energy in each band radiates from a common phase center. This simplifies the arrangement of associated subreflectors.

22 Claims, 4 Drawing Sheets

MULTIPLE FREQUENCY ANTENNA FEED

BACKGROUND OF THE INVENTION

This invention was made with Government support under Contract Number F-04701-81-C-0022 awarded by the United States Air Force. The Government has certain rights in this invention.

This invention relates to antenna structures and more particularly to a multiple frequency feed adapted for use with parabolic reflector antennas.

It is common to use antennas having paraboloidal reflectors in applications such as space communications where radio frequency signals in the form of microwave frequency electromagnetic waves are transmitted between an earth station and a satellite or vice versa. Such antennas may be constructed in a prime focus configuration where microwave frequency energy is coupled to a transceiver by an antenna feed mounted near a focal point of the paraboloidal reflector. The antennas may also be constructed in other configurations such as Gregorian or Cassegrain. Doubly-shaped reflectors may be used as well. These configurations use a small hyberboloidal subreflector mounted near the focal point of the paraboloidal reflector, allowing the feed to be placed between the paraboloidal and hyperboloidal reflectors. Paraboloidal reflector antennas are also used in radar and other communications applications as well.

Regardless of feed configuration or system application, it is the purpose of the feed to connect a transceiver to the paraboloidal reflector. Antennas intended for operation over multiple frequency bands normally require a corresponding number of multiple feeds and subreflectors. U.S. Pat. No. 4,092,648 to Fletcher, et al. issued May 30, 1978, and assigned to the National Aeronautics and Space Administration of the United States Government, shows a typical multiple band antenna having a main reflector that diverts energy to a subreflector and then to a flange. The flange is arranged to pass radiation in a first frequency band to first horn. Energy in a second frequency band is reflected by the flange to an auxilliary reflector. The auxilliary reflector is arranged to feed energy to a second horn.

If operation in more than two frequency bands is required, subreflector, auxilliary reflector, and multiple horn configurations become more complicated. In some instances, it is desirable to tilt and rotate the subreflectors about a symmetry axis in order to provide better tracking of the satellite or other signal source. This further complicates construction and operation of the antenna. It is of course desirable to keep the antenna assembly as small and simple as possible.

SUMMARY OF THE INVENTION

It is thus an object of this invention to provide an improved feed apparatus for multiple band parabolic antennas.

Another object is to provide radiating elements adapted for simultaneous operation with a coaxial feed.

A further object is to provide a feed apparatus having nearly coincident phase centers for all operating bands, thereby simplifying the arrangement of an associated subreflector.

Yet another object is to provide a feed apparatus allowing the use of multiple subreflectors arranged concentrically or otherwise in a closely spaced arrangement.

Still another object of this invention is to provide a multiple band antenna feed having nearly equal beamwidths in its electric and magnetic field planes.

A still further object is to provide a circularly polarized antenna feed capable of operating in at least two frequency bands simultaneously.

Briefly, these and other objects are accomplished by an apparatus having an inner waveguide disposed within a larger outer waveguide. The inner waveguide carries signals in a first frequency band and the outer waveguide carries signals in a second frequency band. A conical horn disposed adjacent the inner and outer waveguides adapts them for coupling to a parabolic reflector. A circular array of patch antenna elements is positioned about the periphery of the horn and carries signals in a third frequency band to or from the reflector.

The inner waveguide is positioned coaxially with, but not touching, the horn to cause signals to radiate between the inner waveguide and the horn with a desired beamwidth. The outer waveguide is directly attached to the horn. The horn thus also serves to radiate signals to or from the outer waveguide with the desired beamwidth. The patch array is formed as a microstrip circuit or by some other planar fabrication technique appropriate for its operating frequency.

Additionally, the feed may contain polarizers to obtain circular polarization from signals fed with other polarizations. For example, the inner waveguide may use a septum and a cross polarization load to adapt it for connection to a linearly polarized rectangular waveguide. Adaption to linear polarization may be similarly achieved for the outer waveguide by using a stepped transition and one-quarter wave dielectric card polarizers.

An impedance matching dielectric ring may be positioned at the interface of the outer waveguide and the horn.

As it is desirable for the transmitted energy in at least two of the bands to have coincident phase centers, the horn, inner waveguide, and patch array are appropriately dimensioned and positioned. This simplifies the construction and arrangement of associated subreflectors.

BRIEF DESCRIPTION OF THE DRAWINGS

The foregoing, as well as other objects, features, and advantages of this invention may be more completely understood by reference to the following detailed description when read together with the accompanying drawings where.

DETAILED DESCRIPTION OF THE PREFERRED EMBODIMENTS

Figure 1:
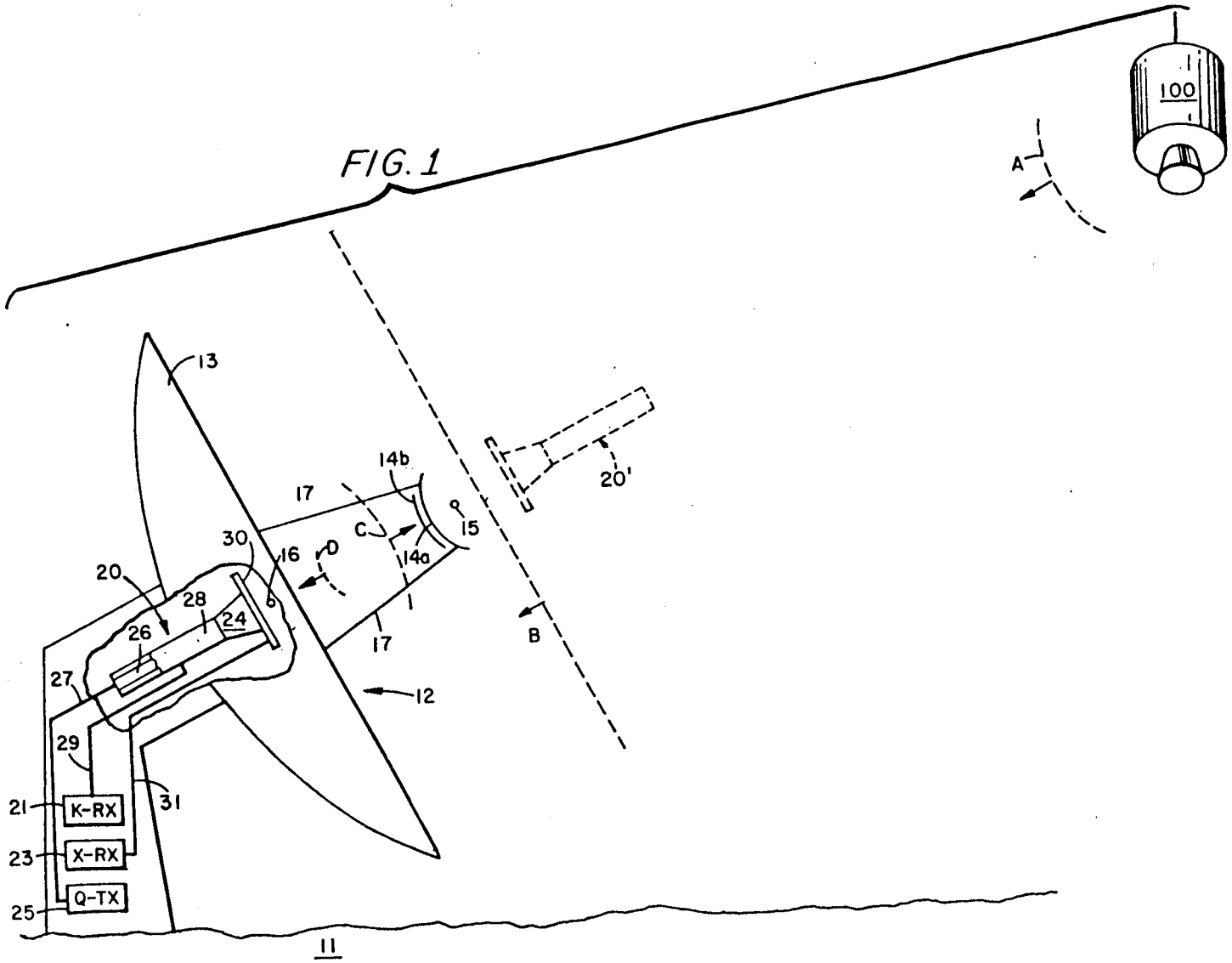
FIG. 1 shows a paraboloidal reflector antenna according to this invention.

Referring now to the drawings, where like reference characters designate corresponding parts throughout the several figures, there is shown in FIG. 1 a view of a space communications system including a satellite 100, adapted for orbiting the earth 11, and an earth station 12. Earth station 12 sends and receives microwave frequency energy to and from the satellite 100. The earth station may be fixed, mobile, shipboard, or airborne. As shown, earth station 12 preferably includes a paraboloidal reflector 13 (sometimes referred to as a dish) in Cassegrain configuration, one or more hyperboloidal subreflectors 14*a* and 14*b* positioned adjacent a focal point 15 of the reflector 13 by support members 17 and having a common subreflector focal point 16, an antenna feed 20 positioned near subreflector focal point 16, and transceivers such as K-band receiver 21, X-band receiver 23, and Q-band transmitter 25. As seen shortly, antenna feed 20 collects energy from or provides energy to reflector 13 and thus couples transceivers 21, 23, and 25 to the reflector 13. While the transceivers shown here include two receivers 21 and 23 and one transmitter 25, other combinations of receivers and transmitters are possible.

In downlink operation, communications signals are transmitted by the satellite 100 and received by earth station 12. These communication signals originate as a microwave frequency energy burst, such as that indicated at position A near satellite 100. The energy burst travels in the direction indicated by the arrow towards earth station 12. Upon arrival at a point B near earth station 12, the energy burst is now dispersed. Reflector 13 serves to collect and focus the dispersed energy burst to improve detection of the communication signal. At point C, the energy burst has been reflected by reflector 13 and is being focused as it travels towards reflector focal point 15. The hyperboloidal subreflector 14*b*, formed of a dichroic material sufficient to reflect energy in the frequency band of operation of the downlink (such as X or K-band) and pass energy in other frequency bands (such as Q-band used for an uplink), reflects the energy burst back towards reflector 13. Thus, at point D, the energy burst is being further focused as it travels towards subreflector focal point 16. The energy burst is then coupled to one of the receivers 21 or 23 by antenna feed 20. For uplink operation, where communications signals are transmitted by earth station 12 and received by satellite 100, energy travels reciprocally. That is, after an energy burst originates at transmitter 25, it travels through antenna feed 20, subreflector focal point 16, and subreflector 14*b* to subreflector 14*a*, to reflector 13, and then to satellite 100. As mentioned, subreflector 14*b* is formed of a dichroic material that passes energy in the uplink frequency band. Subreflector 14*a* is metallic or other material suitable for reflecting energy in the uplink frequency band. The use of a dichroic subreflector 14*b* and metallic subreflector 14*a* having common focal point 16 allows simultaneous operation of the uplink and downlink.

As also seen in FIG. 1, antenna feed 20 includes a conical horn 24 attached to an outer circular waveguide 28. An inner circular waveguide 26 is positioned inside of and coaxial with outer waveguide 28. A circular array of patch elements 30 is positioned adjacent horn 24. The K-band receiver 21 is attached to outer waveguide 28 by an appropriate outer waveguide coupling 29 (such as a rectangular waveguide of the industry standard WR-42 type). Q-band transmitter 25 is similarly connected to inner waveguide 26 by an appropriate inner waveguide coupling (such as WR-22 rectangular waveguide). In downlink operation, energy bursts are collected by horn 24 from subreflector focal point 16, and converted and fed down outer waveguide 28 to K-band receiver 21. In uplink operation, microwave signals are fed down inner waveguide 26 to horn 24 to create a focused energy burst at subreflector focal point 16.

A second downlink frequency band is accommodated by the circular array 30 positioned concentric with and about the periphery of horn 24. Circular array 30 collects energy bursts in a third frequency band, such as X-band, and via an appropriate circular array coupling 31 (such as a coaxial cable) feeds resulting electrical signals to X-band receiver 23.

Figure 2:
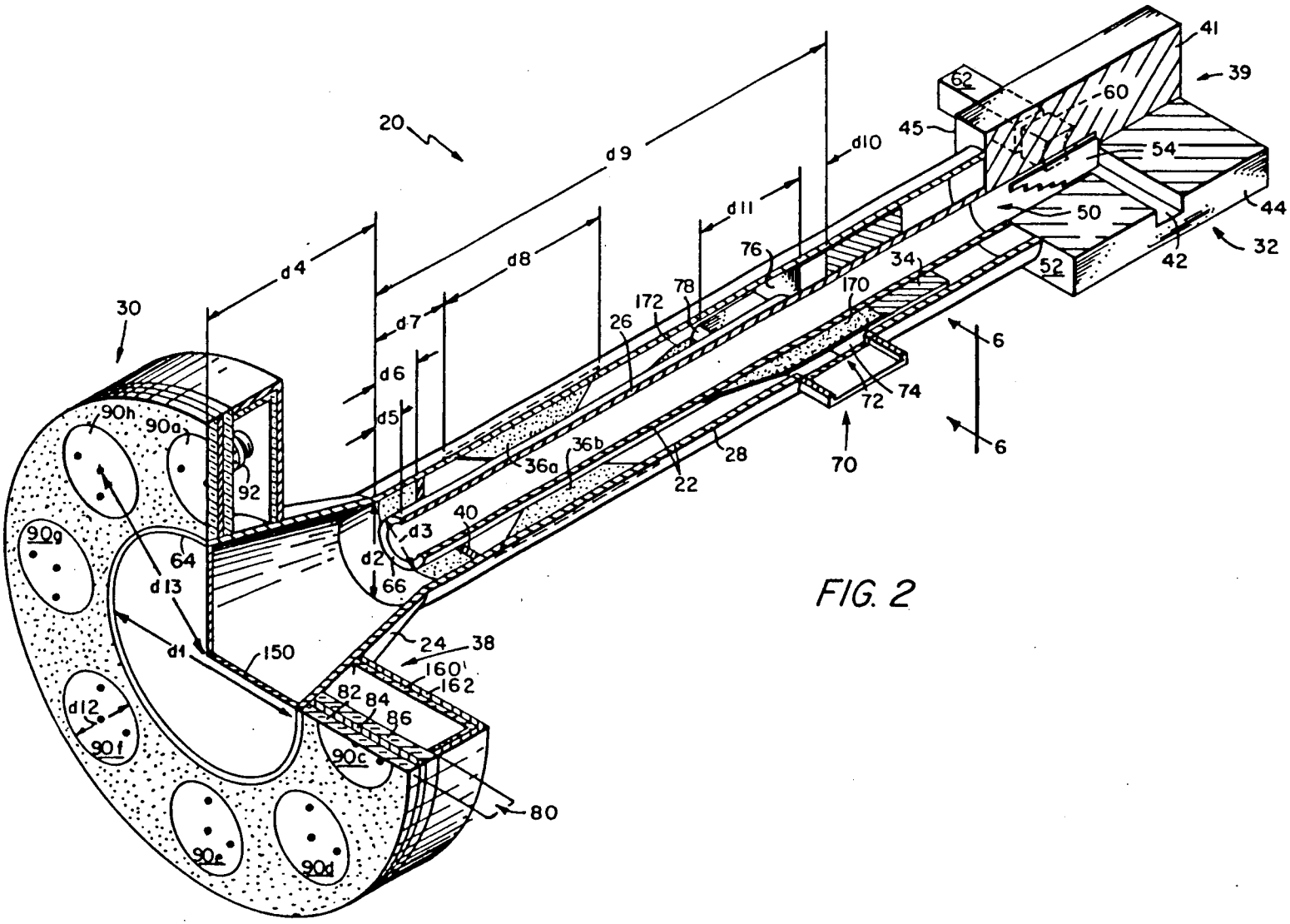
FIG. 2 is a cutaway isometric view of an antenna feed according to this invention.

The structure and operation of antenna feed 20 can be better understood by referring to the detailed view shown in FIG. 2. As previously mentioned, antenna feed 20 includes an outer circular waveguide 28, inner circular waveguide 26, horn 24, and circular array 30. Antenna feed 20 also preferably includes a septum polarizer 32, a rectangular to circular stepped transition 34, a pair of dielectric card polarizers 36A and 36B, and a dielectric matching ring 40.

The structure and operation of each of three operating portions of antenna feed 20 including a Q-band portion, a K-band portion, and an X-band portion shall be described separately. In the following discussion, the end of feed 20 near horn 24 is referred to as its forward end, and the opposite end of feed 20 near polarizer 34 is referred to as the rear end.

The Q-band portion of antenna feed 20 includes the septum polarizer 32, the inner circular waveguide 26, and horn 24. The body of septum polarizer 32 is preferably formed from a block 41 of material such as brass. A Q-band rectangular waveguide 42 is formed in block 41 and appropriately sized to match a rectangular waveguide such as the industry standard WR-22. The rectangular waveguide 42 is continued straight through the block 41 between a front side 44 and an opposing side 45. An adjacent side 52 of block 41 runs between and perpendicular to front and opposing sides 44 and 45. A circular waveguide 50 is also formed in block 41 perpendicular to rectangular waveguide 42. Circular waveguide 50 extends from a central portion of rectangular waveguide 42 to the adjacent side 52. The rectangular and circular waveguides 42 and 50 of septum polarizer 32 are drilled, machined or otherwise appropriately cut in the block 41. A metallic septum 54 is placed within rectangular waveguide 42 parallel to both front and opposing sides 44 and 45 and extends into the circular waveguide 50. The septum 54 serves to convert linearly polarized energy in the input rectangular waveguide 42 to right hand circularly polarized energy in circular waveguide output 50. An orthogonal rectangular waveguide port 60 is thus formed in opposing side 45 of block 41 where rectangular waveguide 42 ends. A cross polarization load 62 formed of an appropriate lossy material is placed adjacent orthogonal rectangular port 60. One end of inner circular waveguide 26 is placed near adjacent side 52 of septum polarizer 32 and aligned with circular waveguide 50. The horn 24 is placed adjacent a forward end 66 of inner circular waveguide 26, opposite septum polarizer 32. The conically shaped horn 24 serves as the radiating structure for energy coupled to the inner circular waveguide 26 by septum polarizer 32. As will be described in more detail shortly, the inner diameter of horn 24 is the same as the diameter of outer circular waveguide 28. Thus, the circularly polarized energy coupled to inner circular waveguide 26 is transitioned to a larger circular waveguide provided by the horn 24. The horn 26 is appropriately sized so that this step to a larger waveguide overmodes the Q-band energy and creates a TM-11 propagation mode in addition to a dominant TE-11 mode. The horn is dimensioned so that these two modes are properly phased when Q-band energy departs from the horn 24. The horn is also sized and positioned so that the phase center of the propagated energy is near the center of outer aperture 64 of horn 24 and that transmitted beamwidths in both the E and H planes are as desired. In the preferred embodiment, the transmitted beamwidth in the E and H planes is approximately 32° at 10 dB.

The Q-band portion of antenna feed 20 operates as an uplink as follows. Q-band energy is coupled from Q-band transmitter 21 (FIG. 1) to feed 20 via rectangular waveguide 42 in block 41. This energy travels down rectangular waveguide 42 until it reaches septum 54. Septum 54 converts the linearly polarized energy in rectangular waveguide 42 to right hand circularly polarized energy in circular waveguide 50. Reflected left-hand circularly polarized energy is converted to linearly polarized energy by septum 54 and travels down rectangular waveguide 42 to the orthogonal rectangular waveguide port 60. Cross polarization load 62 serves to properly terminate this reflected energy. Meanwhile, the right hand circularly polarized energy continues down circular waveguide 50 and inner circular waveguide 26. The circularly polarized energy then propagates from forward end 66 of inner circular waveguide 26 and is transitioned into conical horn 24. Horn 24 provides the desired beamwidth and phase center for the energy as it propagates away from feed 20.

The K-band portion of antenna feed 20 consists of a K-band rectangular waveguide 70 positioned adjacent a mid-portion of outer circular waveguide 28. K-band rectangular waveguide 70 is preferably one conforming to the WR-42 industry standard waveguide specification. A similarly sized rectangular opening 72 is formed in outer waveguide 28 to accommodate rectangular waveguide 70. Positioned adjacent opening 72 is stepped transition 34. Stepped transition 34 is essentially a cylindrically shaped step formed from an appropriate metal such as brass. Stepped transition 34 is bored along its major axis at a diameter slightly larger than the outer diameter of inner circular waveguide 26. This allows the inner waveguide 26 to be placed inside and through stepped transition 34. Stepped transition 34 preferably includes a first step 74, a second step 76, and a third step 78. First step 74 is essentially semi-circular. Second step 76 is also approximately semi-circular but third step 78 is formed thereon. Positioned adjacent first and third steps 74 and 78 are K-band cross polarization loads 170 and 172. K-band loads 170 and 172 are formed from a thin resistive film and serve to absorb the cross-polarized energy created by transition 34. Stepped transition 34 and loads 170 and 172 are described in greater detail in the discussion of FIG. 5. Dielectric card polarizers 36A and 36B are placed between inner and outer waveguides 26 and 28 forward of stepped transition 34. As will be described in greater detail in connection with FIGS. 6 and 7, dielectric card polarizers 36A and 36B are one-quarter wave, tapered, and formed from appropriate material such as as resin filled fiberglass. They preferably have a dielectric constant in the range of 2.5 to 5.5. They are positioned at a 45° angle as measured with respect to an incident E field associated with the linearly polarized K-band energy fed to antenna feed 20 via rectangular waveguide 70. A matching ring 40 is positioned forward of dielectric card polarizers 36A and 36B. This matching ring 40 is formed of an appropriate dielectric material and serves to impedance match outer waveguide 28 to horn 24. The horn 24, in addition to the previously recited description of its physical position for Q-band operation, is positioned and dimensioned to also provide the desired beamwidth at K-band (preferably 50° at 10 dB).

In operation, the K-band portion of antenna feed 20 acts as a downlink. Energy is collected by horn 24 and fed along outer circular waveguide 28. Dielectric matching ring 40 serves to impedance match the horn 24 to the outer circular waveguide 28 and the other elements of the K-band portion of antenna feed 20. Energy is then converted from circular polarization to linear polarization by the two card polarizers 36A and 36B and the cross-polarized energy terminated by loads 170 and 172. The outer circular waveguide 28 thus serves both as an outer wall for shielding the Q-band energy inner circular waveguide 26 and as a conductor for the K-band energy. The K-band energy carried by outer waveguide 28 is propagated to the rectangular waveguide 72 by stepped transition 34.

It can now be seen how a single conical horn 24 is used to control the beamwidth and phase centers for both Q-band and K-band energy.

The X-band portion of feed 24 includes circular array 30. Circular array 30 is formed as a multi-layer microstrip circuit board 80 including a forward dielectric layer 82, a rear dielectric layer 86, and a ground plane layer 84 sandwiched between forward and rear dielectric layers 82 and 86. Circular array 30 includes a number of circular patch radiating elements **90*a* through 90*h* (90*b* is not shown in the cutaway view of FIG. 2) formed on the outer surface of forward layer 82. Appropriately placed holes plated through the patch elements 90*a* through 90*g* provide the desired left hand circular polarization. The diameter of patches 90*a* through 90*h* and their relative spacing and position controls the beamwidth of array 30 (also preferred to be 50° at 10 dB, identical to the K-band beamwidth). The phase center of array 30 appears slightly towards the rear of ground plane 84, very close to the phase centers of the Q and K-band portions of feed 20**.

As the X-band feed operates as a downlink, circularly polarized energy is received by circular patch elements **90*a* through 90*h* and fed to appropriate power combiners (not shown in FIG. 2) formed on the surface of rear dielectric layer 86. The combined energy is then fed through a coaxial connector 92 or other suitable connector for feeding energy from patch array 30. Patch array 30 is later shown in greater detail in FIGS. 8 through 10**.

One set of dimensions has been found to provide the desired operation of antenna feed 20 as a Q-band uplink as well as a K and X-band downlink. These dimensions, indicated in FIG. 2 as reference characters d1-d13, are as follows:

| Dimension | Nominal (In) | Description |
|---|---|---|
| d1 | 1.140 | horn forward inner diameter |

-continued

| Dimension | Nominal (In) | Description |
|---|---|---|
| d2 | 0.437 | horn rear or outer waveguide inner diameter |
| d3 | 0.200 | inner waveguide diameter |
| d4 | 1.403 | horn length |
| d5 | 0.368 | horn to inner waveguide |
| d6 | 0.544 | horn to dielectric ring |
| d7 | 0.627 | horn to card polarizer |
| d8 | 0.833 | card polarizer length |
| d9 | 1.873 | horn to first step |
| d10 | 0.252 | first step to second step |
| d11 | 0.145 | second step to third step |
| d12 | 0.500 | patch diameter |
| d13 | 1.000 | array patch center radius |

Various elements of antenna feed 20 are now described in greater detail.

Figure 3:
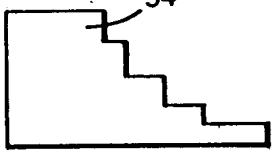

FIG. 3 is a closer view of the stepped septum 54 portion of septum polarizer 32.

Figure 4:
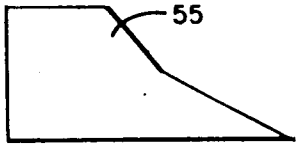
FIGS. 3 and 4, respectively, show stepped and sloped septums that may be used with the feed.

A sloped septum 55 such as that shown in FIG. 4 may be substituted for stepped septum 54 and provides the same function.

Figure 5:
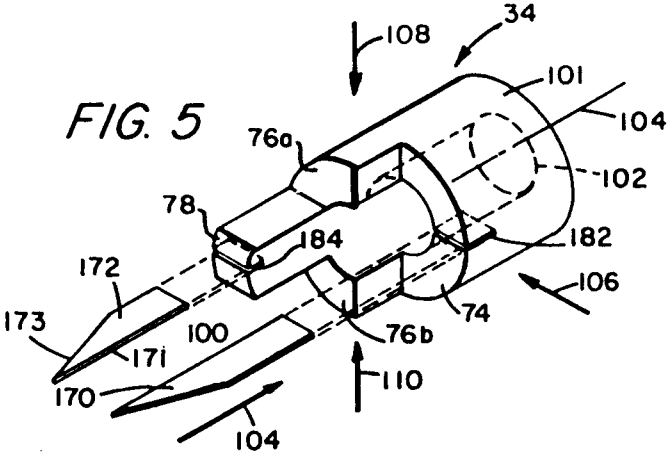
FIG. 5 is an isometric view of a circular stepped transition and cross polarization loads that may be used with the antenna feed.

FIG. 5 is a more detailed view of stepped transition 34. As seen, stepped transition 34 is essentially a metal cylinder having a cylindrical hole 102 formed concentrically with its major axis 104. Stepped transition 34 has a cylindrical hole 102 (as indicated by the dashed lines) bored along its major axis 104. A first step 74, a second step 76, and a third step 78 are formed by appropriate longitudinal and latitudinal cuts along and perpendicular to major axis 104. For example, a first longitudinal cut in the direction of arrow 104 and second longitudinal cut in the direction of arrow 106 serve to define the semi-circular first step 74. The first longitudinal cut is parallel with and preferably in the same plane as major axis 104. The second longitudinal cut is perpendicular to major axis 104. Stepped transition 34 thus has a forward face 100, formed as a portion of a circle. Another cut, this one being in a horizontal plane above major axis 104, is also made in the direction of arrow 104 from the forward face 100 towards first step 74, but terminates before intersecting the plane of first step 74. Similarly, a horizontal cut is made in a plane below major axis 104. Finally, downward and upward cuts in the direction of arrows 108 and 110 perpendicular to major axis 104 and in parallel with forward face 100 serve to define upper and lower portions 76*a* and 76*b* of second step 76. The portion of forward face 100 remaining after these cuts serves as third step 78.

As mentioned previously, K-band cross polarization loads 170 and 172 are preferably included adjacent stepped transition 34. K-band loads 170 and 172 are formed as a thin card of resistive material. The preferred material is a carbon-loaded polyester film (such as Mylar, a trademarked product of the E.I. DuPont De Nemours Corporation) exhibiting a resistivity in the 200–600 ohms per square range. A slot 182 formed in first step 74 engages K-band load 170 at its rear end and holds it perpendicular to first step 74. Likewise, slot 184 formed in third step 78 engages the rear end of K-band load 172. The portion K-band load 172 extending away from and forward of third step 78 is tapered, as shown in FIG. 5, so that it becomes narrower as distance from the third step 78 increases. The taper is such that a continous angle is formed between an outer tapered edge 173 and inner straight edge 171 of K-band load 172. The continous angle between edges 171 and 173 is preferably 21°.

The portion of K-band load 170 extending forward of third step 78 is similarly tapered. The portion of K-band load 170 extending between first step 74 and third step 78 is not tapered.

Figure 6:
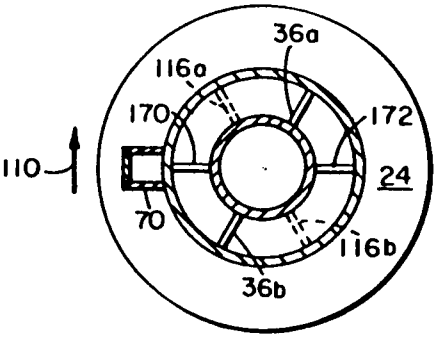
FIG. 6 is a cross sectional view of an inner and outer waveguide portion of the feed and associated card polarizers.

FIG. 6 is a partial cross sectional view of antenna feed 20. This view shows the orientation of dielectric card polarizers 36A and 36B with respect to K-band rectangular waveguide 72. The view is taken looking forward towards horn 24 and circular array 30 in the plane 5—5 of FIG. 2 with the stepped transition 34 removed for clarity. The incident E-field in this instance is in the direction of arrow 110. It can be seen that both the upper dielectric card polarizer 36A and lower dielectric card polarizer 36B form a 45° angle with the incident E-field. The orientation shown has the lower dielectric card polarizer 36B closer to K-band rectangular port 70 to provide right hand polarization. If dielectric card polarizers 36A and 36B are placed in an orthogonal position, as indicated by the dashed lines 116A and 116B, the left hand circular polarization can be achieved.

Figure 7:
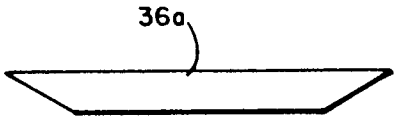
FIG. 7 is a plan view of a typical card polarizer.

FIG. 7 is a plan view of one of the card polarizers, 36*a*, showing its tapered ends.

Figure 8:
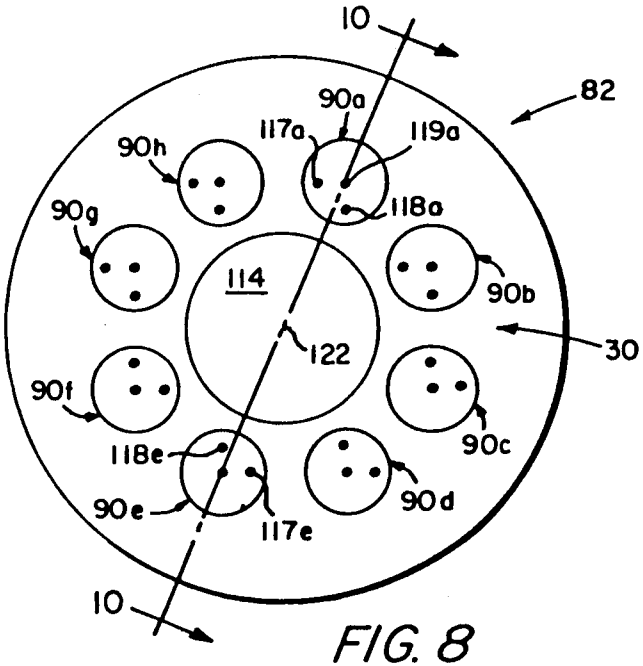
FIGS. 8 and 9, respectively, are forward and rear views of a circular array portion of the feed.

FIG. 8 is a view of the forward dielectric layer 82 of microstrip circuit board 80 showing the circular array 30 of circularly polarized patch elements 90*a* through 90*h*. This is the preferred configuration for operation of the circular array 30 at X-band with eight circular patch elements. Other embodiments for different bands or beamwidths might require a lesser or greater number of patches. The forward dielectric layer 82, as well as the other layers forming microstrip circuit board 80 including ground layer 84 and rear dielectric layer 86, have a central hole 114 to accommodate the outer diameter of the forward end of horn 24. The eight patch elements 90*a* through 90*h* are symmetrically arranged around the central hole 114. The operating frequency of the patch array 30 is controlled by the diameter of the patch elements 90*a* through 90*h* and the dielectric constant of the material on which the patch array is etched. Forward layer 82 is formed using microstrip techniques on a dielectric substrate. Such a substrate preferably has a dielectric constant of 2.2. One such dielectric is sold by Rogers Corporation under the trademark Duroid 5880. Substrate thickness determines operating bandwidth.

As previously mentioned, the patches 90*a* through 90*h* preferably have a diameter of approximately one-half inch, and are arranged in a circle so that their centers are approximately one inch from an array center point 122. This patch element sizing and spacing has been found to provide 50° 10 dB beamwidth at *X*-band.

Three plated through holes are formed in each patch element. As shown for an exemplary patch element 90*a*, a center plated through hole 119*a* is formed adjacent the center of patch 90*a*. A left side plated through hole 117*a* and lower plated through hole 118*a* are formed at positions to the left of and below center hole 119*a*, when looking at forward layer 82 in plan view. Plated through hole 119*a* serves as a ground reference point. Left side plated through hole 117*a* and lower plated through hole 118*a* serve as quadrature feed probes. That is, they collect energy bursts fed to patch 90*a* and provide two electrical signals phased at 90° with respect to each other, thereby accomplishing the desired left hand circular polarization. Plated through holes 117*a* and 118*a* thus connect patch portions of patch element 90*a* to rear layer 86. Plated through hole 119*a* connects another portion of patch element 90*a* to ground plane layer 84 and rear layer 86.

Patches 90*b* through 90*h* are similarly formed. In the preferred embodiment, four of the eight patches have their plated through holes in reversed position. For example, 90*e* has center plated through hole 119*e* but an upper plated through hole 118*e* and right side plated through hole 117*e*. This reversed positioning of one-half of the patches' plated through holes provides better control over the location of the phase center of patch array 30.

Figure 9:
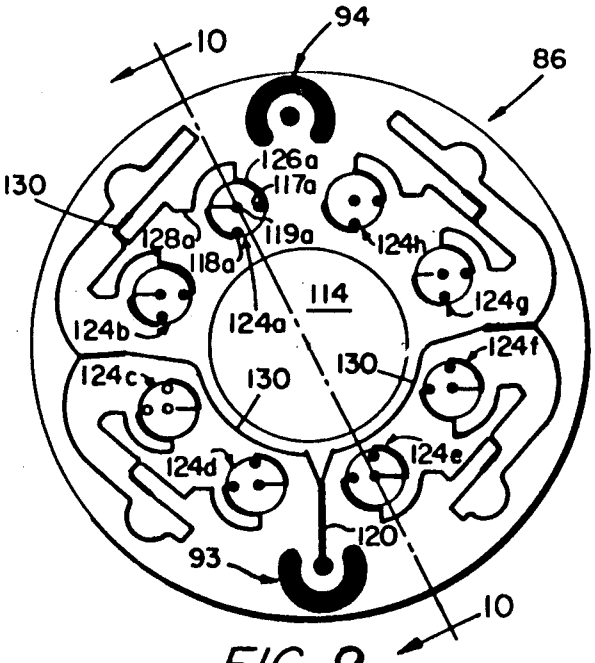

FIG. 9 shows a plan view of rear layer 86. A coaxial connector portion 93 serves to couple rear dielectric layer 86 to an external signal feed such as coaxial cable 31 and hence to X-band receiver 23 (FIG. 1). A dummy mirror image coaxial connector portion 94 provides better symmetry. Coaxial connector portion 93 couples the external signal feed to a main microstrip conductor 120. Rear layer 86 preferably includes eight quadrature hybrid elements 124*a* through 124*h*.

An exemplary quadrature hybrid 124*a* connects the electrical signals from feed probes 117*a* and 118*a*. Hybrid 124*a* is a ring shaped piece of microstrip transmission line 126*a*. This microstrip ring 126*a* provides an equal power combiner input from each of the feed probes 117*a* and 118*a*, with the signals fed from each probe forced to be 90° out of phase with respect to the other. Center plated through hole 119*a* connects hybrid 124*a* to the central ground plane 84 and also to patch 90*a*. The output of hybrid 124*a* is fed along a section of transmission line 128*a*. An eight to one power combiner 130 (also formed of transmission line) couples transmission line section 128*a* to main conductor 120. The energy fed to each of the other patch elements 90*b* through 90*h* are similarly combined by hybrids 124*b* through 124*h* and coupled through power combiner 130 to main conductor 120. Rear layer 86 is formed on appropriate microstrip dielectric substrate such as Duroid 5880.

Figure 10:
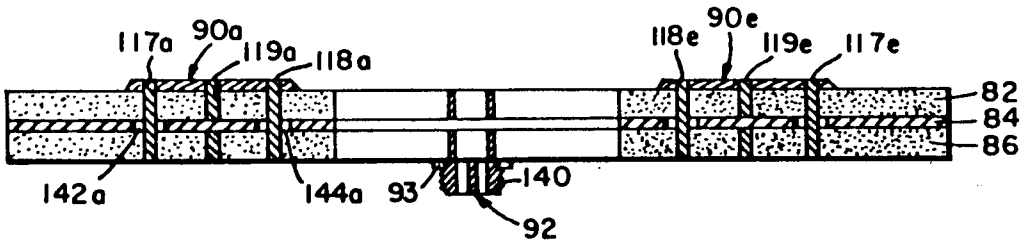
FIG. 10 is a cross sectional view of the circular array.

FIG. 10 is a cross sectional view taken across planes 10–10 of FIGS. 8 and 9. It shows forward layer 82, ground plane layer 84 and rear layer 86 and their respective orientations. Patch elements 90*a* and 90*e* are shown in cross section. Coaxial input connector 92 is also shown. It can be seen that center plated through hole 119*a* is electrically and physically attached to ground plane layer 84 as well as outer ground or shield portion 140 of coaxial connector 92. This serves to provide a ground reference at the center of each of patch elements 90*a* through 90*h* and quadrature hybrids 124*a* through 124*h*. Holes such as 142*a* and 144*a* are formed in ground plane 84 and serve to isolate feed probes 117*a* and 118*a* from ground plane 84.

Having described a preferred embodiment of this invention, it will now be evident that other embodiments incorporating these concepts may be used. For example, a weather window 150 (FIG. 2) formed of a material transparent to microwave frequency energy (such as quartz) may be positioned at the forward end of horn 24 to keep dirt or other undesirable elements from entering waveguides 26 and 28.

A tapered dielectric rod may be inserted in inner conductor 26 (FIG. 2) to encourage the dominant hybrid HE-11 mode. If used, the tapered rod is preferably shaped to provide the desired beamwidth (such as 32° at 10 dB) in both the E and H planes. The tapered rod may be adapted to assist impedance matching horn 24 or controlling energy beamwidth.

A cup-shaped metallic shield 162 (FIG. 2) may be fit around rear layer 86 of patch array 30 to assist in preventing radio frequency interference from disturbing the operation of array 30. An inner cup-shaped absorber 160 may also be placed inside of the shield to prevent radiation from patch array 30 interfering with its own operation.

Other appropriate waveguide sections may be used instead of K-band rectangular waveguide 72 and Q-band rectangular waveguide 42 to provide access to transceivers 21, 23, and 25. A structural support member may be positioned adjacent the rear portion 38 of antenna feed 20 to serve as a base for other structural members serving to support horn 24 and array 30.

The dimensions and dielectric constants described are for the operating bands of the preferred embodiment and can be scaled to allow operation at other frequencies.

Other multi-band paraboloidal antennas may also be accommodated. For example, the patch array 30 may be fabricated to operate at K-band and the horn 24 could be sized for Q-band operation. Earth station 12 may be arranged in other configurations. For example in a prime focus configuration, antenna feed 20 is instead positioned adjacent reflector focal point 15 and facing inward towards reflector 13 (as shown by the dashed lines 20' in FIG. 1). Subreflectors 14*a* and 14*b* are eliminated in this configuration. The feed 20 may also be used in other configurations such as offset prime focus, offset Cassegrain, and Gregorian and the like.

The coaxial waveguide 22 may be formed as coaxial rectangular waveguides and may be arranged to accommodate other polarizations.

A second dichroic subreflector can be placed adjacent subreflectors 14*a* and 14*b* to allow similtaneous operation in all three bands and/or operational selection of any band as an uplink or downlink.

The circular array of circular patch elements 30 can be used in other applications requiring a radiating antenna element.

In view of these and other evident possible variations, this invention is not restricted to the disclosed embodiments, but rather is limited only by the spirit and scope of the claims that follow.

What is claimed is:

1. A antenna feed comprising:

an outer circular waveguide having a central axis and cross-sectional dimension;

an inner circular waveguide having a central axis, a cross-sectional dimension less than the cross-sectional dimension of the outer waveguide, and positioned inside of the outer waveguide so that the outer waveguide central axis is aligned with the inner waveguide central axis;

a plurality of patch elements arranged as a circular array about an array center point and positioned adjacent a forward end of the outer waveguide; and a conical horn, having a small openings and a large opening, the small opening positioned adjacent the forward end of the outer waveguide and the large opening adjacent and coaxial with the array center point.

2. Apparatus as in claim 1 additionally comprising: a dielectric matching ring positioned inside of the outer waveguide in a space between the inner and outer waveguides, near the outer waveguide forward end and the small opening of the conical horn.

3. Apparatus as in claim 1 additionally comprising: a weather window positioned adjacent the large opening of the conical horn.

4. Apparatus as in claim 1 additionally comprising: polarizing means, positioned adjacent a rear end of the outer waveguide opposite the forward end, for coupling energy from an energy source to the inner waveguide, and for converting the energy from a first polarization as received to a second polarization inside the inner waveguide.

5. Apparatus as in claim 4 where the polarizing means includes a septum polarizer extending into the inner waveguide and the first polarization is linear and the second polarization is circular.

6. Apparatus as in claim 1 additionally comprising:

transition means, positioned in a middle portion of the outer waveguide between the forward end and a rear end opposite the forward end, for coupling energy from an energy source to the outer waveguide.

7. Apparatus as in claim 6 where the transition means comprises a circular stepped transition having a plurality of steps.

8. Apparatus as in claim 7 additionally comprising:

a card load, positioned adjacent and perpendicular to one of the steps.

9. Apparatus as in claim 6 additionally comprising:

a dielectric card polarizer, positioned in the space between the inner and outer waveguides and between the outer waveguide forward end and the transition means.

10. Apparatus as in claim 1 where the plurality of patch elements are formed on a forward layer of a printed circuit board.

11. Apparatus as in claim 10 where the printed circuit board has a rear layer opposite the forward layer, additionally comprising:

an absorber positioned to surround the rear layer.

12. Apparatus as in claim 10 additionally comprising:

means, positioned adjacent the printed circuit board, for preventing radiation from interfering with the operation of the antenna feed.

13. Apparatus as in claim 12 where the preventing means comprises:

a cup absorber positioned opposite the forward layer of the printed circuit board.

14. Apparatus as in claim 12 where the preventing means comprises:

a shield positioned opposite the forward layer of the printed circuit board.

15. An antenna feed comprising:

an outer circular waveguide having a central axis and cross-sectional dimension;

an inner circular waveguide having a central axis, a cross-sectional dimension less than the cross-sectional dimension of the outer waveguide, and positioned inside of the outer waveguide so that the outer waveguide central axis is aligned with the inner waveguide central axis;

a plurality of patch elements arranged as a circular array about an array center point, and positioned adjacent a forward end of the outer waveguide.

a conical horn, having a small opening and large opening, the small opening positioned adjacent the forward end of the outer waveguide and the large opening adjacent and coaxial with the array center point;

a dielectric matching ring positioned inside of the outer waveguide in a space between the inner and outer waveguides, near the outer waveguide forward end and the small opening of the conical horn;

polarizing means, positioned adjacent a rear end of the outer waveguide opposite the forward end, for coupling energy from an energy source to the inner waveguide, and for converting the energy from a first polarization as received to a second polarization inside the inner waveguide;

transition means, positioned in a middle portion of the outer waveguide between the forward end and a rear end opposite the forward end, for coupling energy from an energy source to the outer waveguide;

a dielectric card polarizer, positioned in the space between the inner and outer waveguides and between the outer waveguide forward end and the transition means; and means, positioned adjacent the patch elements, for preventing radiation from interfering with operation of the antenna feed.

16. An antenna comprising:

a. a parabolic reflector having a focal point;

b. a subreflector positioned adjacent the focal point of the parabolic reflector and having its own focal point; and c. an antenna feed positioned with a forward end adjacent the subreflector focal point, the antenna feed comprising:

an outer circular waveguide having a central axis;

an inner circular waveguide having a central axis and positioned inside of and coaxially with the outer waveguide; and a circular array of circular patch elements, formed on a microstrip circuit board, and arranged near the forward end of the feed.

17. Apparatus as in claim 16 wherein the radiation phase centers of the inner and outer waveguides are coincident.

18. Apparatus as in claim 17 wherein the radiation phase center of the circular array is in close proximity with the coincident radiation phase centers of the coaxial inner and outer waveguides.

19. An antenna comprising:

a. a parabolic reflector having a focal point; and b. an antenna feed positioned adjacent the focal point and facing the reflector, the antenna feed comprising:

an outer circular waveguide having a central axis;

an inner circular waveguide having a central axis and positioned inside of and coaxially with the outer waveguide; and a circular array of circular patch elements, formed on a microstrip circuit board, and arranged near the forward end of the feed.

20. Apparatus as in claim 19 wherein the radiation phase centers of the inner and outer waveguides are coincident.

21. Apparatus as in claim 20 wherein the radiation phase center of the circular array is in close proximity with the coincident radiation phase centers of the coaxial inner and outer waveguides.

22. An antenna array comprising:

a plurality of circular patch elements, arranged as a circular array, the circular array having an array center point, each patch element having a center point, each of said patch element center points being equally distant from the array center point; and a plurality of polarizing means, at least one polarizing means coupled to each circular patch element, for circularly polarizing the circular patch element, said at least one polarizing means comprising first and second feed probes connected to the patch element and disposed substantially orthogonally with respect to the patch element, wherein the at least one polarizing means additionally comprises:

a central ground plated through feed, connected to the patch element at the patch element center point; and transmission line ring means, connected to the first and second feed probes and the ground feed, for providing a combined patch signal.

* * * * *